United States Patent [19]

Jacobson

[11] 4,345,374

[45] Aug. 24, 1982

[54] RAZOR WITH MEANS TO ADJUST BLADE GEOMETRY

[75] Inventor: Chester F. Jacobson, Southboro, Mass.

[73] Assignee: The Gillette Company, Boston, Mass.

[21] Appl. No.: 432,842

[22] Filed: Jan. 14, 1974

[51] Int. Cl.[3] ..... B26B 21/06

[52] U.S. Cl. ..... 30/47; 30/50; 30/57; 30/63

[58] Field of Search ..... 30/38, 47, 50, 54, 57, 30/60, 60.5, 61, 63, 68, 69, 71

[56] References Cited

U.S. PATENT DOCUMENTS

| | | | |
|---|---|---|---|
| 1,121,916 | 12/1914 | Gaisman | 30/57 |
| 1,995,621 | 3/1935 | Moody | 30/69 |
| 2,062,683 | 12/1936 | Smith | 30/57 X |
| 2,799,926 | 7/1957 | Shaylor | 30/63 |
| 3,375,578 | 4/1968 | Nissen | 30/63 X |
| 3,388,831 | 6/1968 | Hansom | 30/47 X |
| 3,816,913 | 6/1974 | Ferraro | 30/47 |
| 3,816,916 | 6/1974 | Kuhnl | 30/47 |

FOREIGN PATENT DOCUMENTS

| | | | |
|---|---|---|---|
| 146052 | 7/1920 | United Kingdom | 30/57 |
| 231732 | 4/1925 | United Kingdom | 30/57 |

*Primary Examiner*—Nicholas P. Godici

[57] ABSTRACT

A razor blade unit has a blade member, a guard member located forward of the exposed edge of the blade member, and integral adjusting mechanism operable independently of the razor handle for changing the positioning of the blade and guard members relative to one another to vary the shaving geometry.

21 Claims, 14 Drawing Figures

RAZOR WITH MEANS TO ADJUST BLADE GEOMETRY

SUMMARY OF INVENTION

This invention relates to safety razors and more particularly to blade units of the type that are arranged for detachable connection to a cooperating handle component, the blade unit including a blade member and a cooperating guard member.

It is frequently desirable to provide a construction in a safety razor which enables the user to adjust the shaving geometry (the relationship between the sharpened edge of the razor blade and the guard member) to suit his individual preferences and/or shaving requirements, and it is an object of this invention to provide a novel and improved blade unit which enables adjustment of shaving geometry simply and reliably.

Blade units of the type which include a blade and guard member as a unit adapted for connection to a separate handle member provide the advantages of a compact structure in which desirable geometrical relationships are established and maintained throughout the useful life of the blade unit. A number of unique problems arise in a blade unit construction of this type in which a shaving geometry adjustment is provided, however. For example, the adjustment should be easy to make and permit a wide range of shaving geometries while not creating any potentially hazardous condition for the user. The incremental production cost of the adjustable feature to the extent that it is incorporated in the replaceable blade unit must be minimized in order to be economically competitive. The blade unit is compact (one of its advantageous features) and the adjustable feature should not unduly complicate the blade unit structure. A number of proposals for adjustment of blade units of this type have been made, for example as shown in German Offenlegungsschrift 2251633. The adjustment arrangements there shown employ auxiliary blade unit structure which interengages adjustment structure when the blade unit is attached to the handle component. It is another object of this invention to provide a novel and improved blade unit structure which includes an integral adjustable shaving geometry mechanism.

Another object of the invention is to provide a novel and improved blade unit shaving geometry adjustment arrangement which enables the shaving geometry to be adjusted effectively and accurately.

Still another object of the invention is to provide a compact shaving geometry adjustment arrangement for use in blade units of the type adapted for detachable connection to handle components.

A further object of the invention is to provide novel and improved shaving geometry adjustment arrangements that are adaptable to high volume production techniques, both in the manufacturing of the components of the blade unit and the assembly of the components into a blade unit.

In accordance with the invention there is provided a blade unit for detachable connection to a handle component and that includes a blade member and a permanently associated guard member. The guard and blade members are mounted for relative movement along a predetermined path and this movement is controlled by an adjustment mechanism integral with the blade unit. Thus the shaving geometry range is a function of the blade unit alone and not a function of the nature of the handle component to which the unit is connected.

In a preferred embodiment of the invention, the blade unit includes a platform member and cap member with a blade member permanently fixed in position between the platform and cap members, together with a transversely extending guard member that defines a guard surface disposed parallel to the cutting edge of the blade. Movement path defining structure is disposed below the blade structure and the adjustment mechanism is located to the rear of the blade member, on the opposite side of the blade unit from the guard structure. The adjustment structure is located in a conveniently accessible position and does not interfere with the shaving operation.

In a particular embodiment, two blade elements are employed and are permanently secured together in fixed geometrical relationship. The two cutting edges are spaced so that two distinct cutting actions occur on the same beard hair that are successive in time but still close enough so that the second cutting action occurs before the beard hair has fully stabilized after first cutting action. Thus there is a dynamic interaction between the two successive cutting actions. This system enables the exposures of both blades to be low. The guard member is movable relative to the two blade members about a pivot axis that extends parallel to the blade edges. The guard member is integral with a frame member that includes a rear wall portion disposed behind the blade members, and an adjusting member carried by the rear wall portion of the frame produces relative movement of the frame and blade members about the pivot axis to adjust the shaving geometry.

In particular embodiments, the adjustment mechanism includes a slider member that is mounted for transverse movement in a slot in the rear wall of the frame member and that has a camming portion that engages a groove in the blade support structure. The groove and slot are disposed in an offset relation, the range of offset changing over the range of movement of the adjusting member.

The invention provides a compact detachable blade unit which includes an economical and efficient shaving geometry adjusting mechanism that is self-contained within the blade unit and does not interfere with shaving and yet is easily adjustable to provide a range of shaving geometries.

Other objects, features and advantages of the invention will be seen as the following description of particular embodiments progresses, in conjunction with the drawings, in which.

DESCRIPTION OF PARTICULAR EMBODIMENTS

Figure 1:
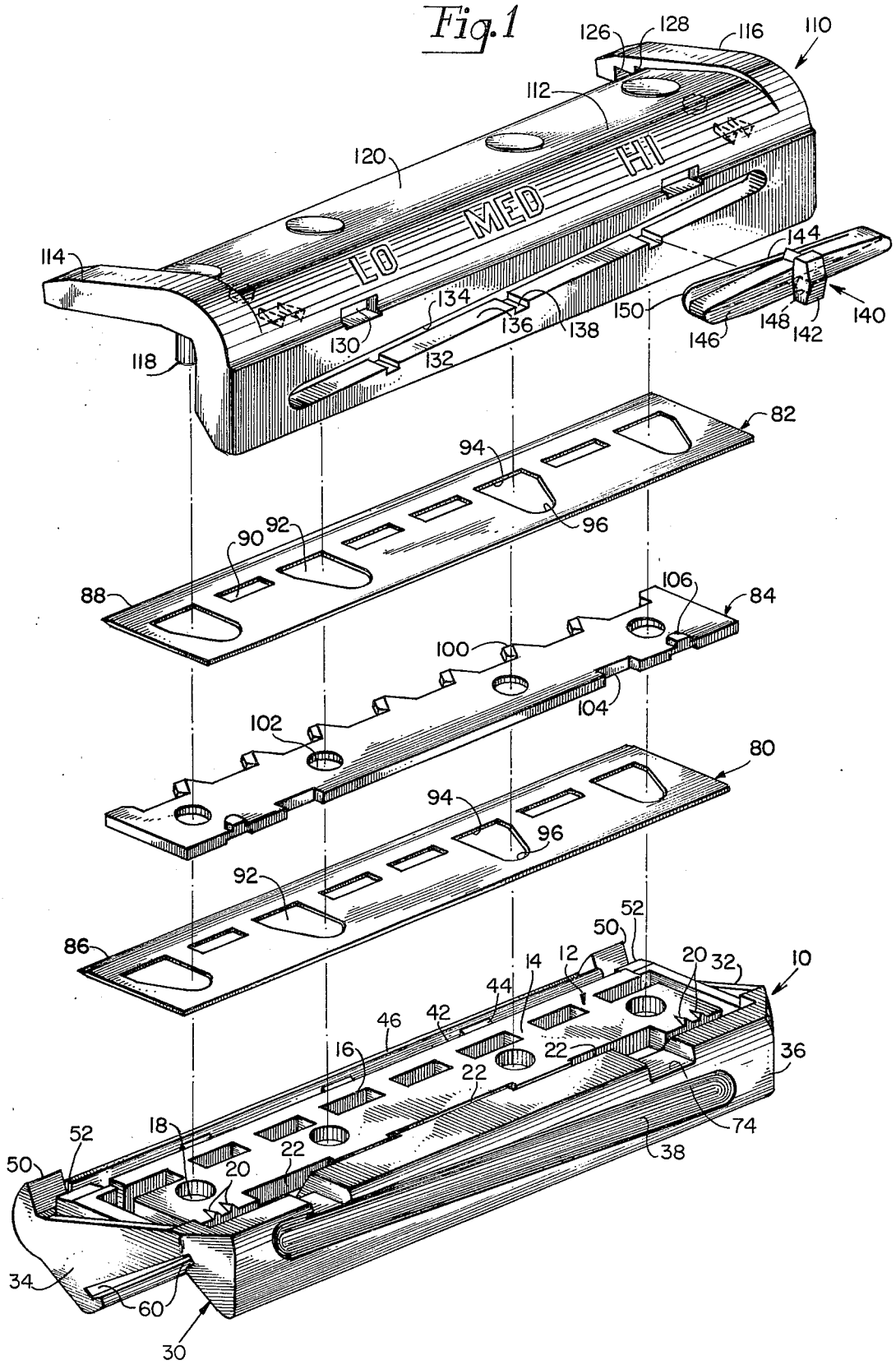
FIG. 1 is an exploded perspective view of components of a blade unit in accordance with the invention.
Figure 2:
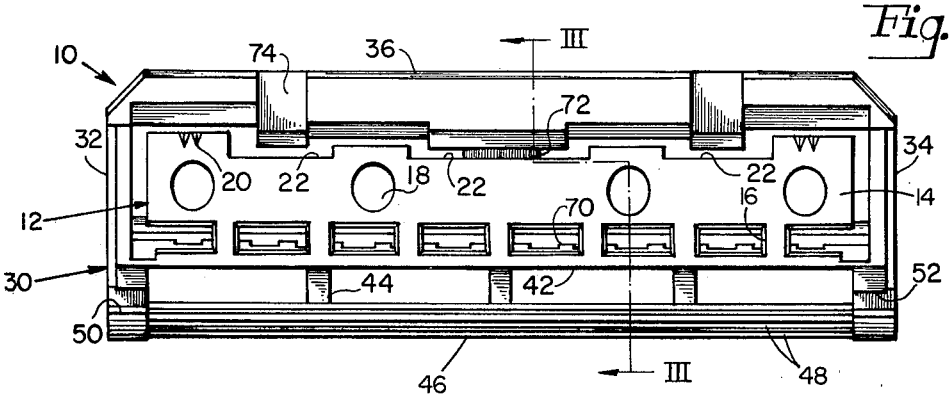
FIG. 2 is a top view of the base member of the blade unit shown in FIG. 1.
Figure 3:
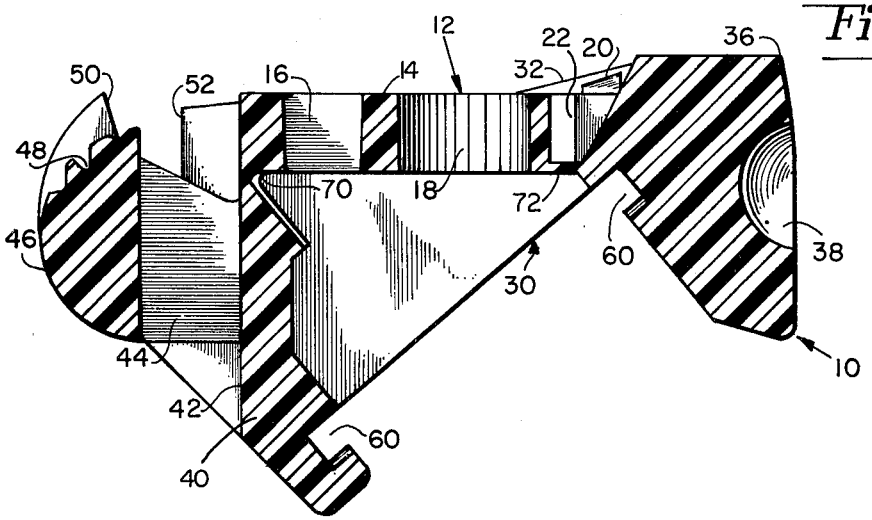
FIG. 3 is a sectional view taken along the lines 3—3 of FIG. 2.

The blade units shown in the drawings are adapted to be used with a handle component of the type shown in U.S. Pat. No. 3,768,162 and are about 1½ inches long and ½ inch wide. With reference to FIG. 1, the illustrated blade unit embodiment includes a base member 10 molded of high impact polystyrene. The base member 10 includes a platform portion 12 in which are formed a series of rectangular apertures 16 and a set of circular apertures 18. Adjacent its rear edge are upstanding triangular projections 20 and recesses 22 are formed in its rear wall.

Platform portion is disposed within frame portion 30 that includes two side wall portions 32, 34; a rear wall portion 36 that includes an inclined cam recess 38; and a front wall portion 40. Webs 44 extend forwardly from front wall surface 42 to guard structure 46 that has a series of transversely extending grooves 48 formed in it. Extending upwardly above guard surface 46 at either end thereof is a guard projection 50 that forms an extension of side wall 32, 34, respectively, and spaced rearwardly of each projection 50 is an aligning surface 52.

Formed in the interior surfaces of rear and front walls 36, 40, respectively, are recesses or grooves 60 which are adapted to receive the rails of the cooperating handle component to secure the blade unit to that handle.

Figure 4:
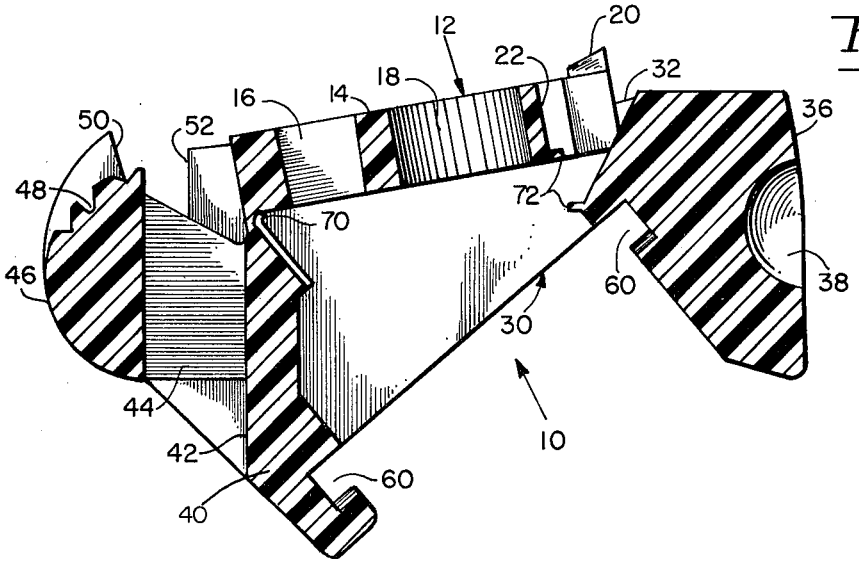
FIG. 4 is a sectional view, similar to FIG. 3, indicating the fracturing of web 72.

The platform member 12 is secured to the front wall 40 of frame 30 by a hinge web 70 that extends the length of front wall 40 between side walls 32 and 34, and initially to the rear wall structure 36 by frangible web 72 that is disposed in central recess 22. Web 72 maintains the desired geometrical relationship between frame and platform portions during assembly but is easily broken to permit platform portion 12 to pivot about the hinge web 70 as indicated in FIG. 4.

Positioned on platform surface 14 are two blade elements 80, 82 and an interposed spacer member 84. Each blade element 80, 82 has parallel front and rear edges, the front edge of each blade element being sharpened to define a cutting edge 86, 88, respectively. Formed in each blade member are a series of four rectangular slots 90 and a series of four irregularly shaped apertures 92. The forward edge 94 of each aperture 92 is straight and of the same length as each slot 90, while the rear edge 96 of each aperture 92 has a curvature corresponding to the curvature of aperture 18 in platform portion 12.

Spacer 84, interposed between the blade elements, has a series of forwardly directed fingers 100 formed at its forward edge, circular apertures 102 that are alignable with holes 18 in the platform portion and with apertures 92 in the blade unit members, recesses 104 in its rear edge that are alignable with recesses 74 in the rear wall of the frame portion, and upstanding projections 106 adjacent the rear edge.

Cap member 110 is also molded of high impact polystyrene and includes a body portion 112 that extends between end wall portions 114, 116. Pins 118 extend downwardly from body portion 112 and are alignable with holes 18, 92 and 102 in the base, blades and spacer member, respectively. The pins 118 have recesses at their lower ends to facilitate cold heading. The top surface 120 of body portion 112 is inclined at an angle of about 75° to the axes of pins 118 and the top surfaces of end walls 114, 116, project above surface 120 and are also similarly inclined to the axis of pins 118. The end wall portions 114, 116 extend beyond the forward edge of body portion 112 and each include vertical reference surfaces 126, 128 that are used to locate the base member 10 and blades 80 and 82 in proper relation relative to cap 110.

Formed in the rear of cap 110 are two recesses 130 and an elongated groove 132 that is inclined at an angle at about 3° to the transverse axis of the cap. Groove 132 has a planar upper wall 134, a lower wall 136 that is generally parallel to wall 134 but has a slight crest at its center, and a series of three latch recesses 138 formed in lower wall 136.

Adapted to be disposed in groove 132 is a slidable adjustment member 140 that includes a handle portion 142, an elongated portion 144 and a coupling portion 146. Portion 144 has a cylindrically curved surface 150 the radius of which is about 0.04 inch that is adapted to be received in semi-cylindrical groove 38 and that is inclined at an angle of about 3° to the transverse axis of the slider 140. The connector or neck portion 146 extends the length of semi-cylindrical portion 144 and has parallel surfaces spaced apart about 0.05 inch. Neck portion 146 is inclined at an angle of about 6° to cam portion 144 and is adapted to be received in guided relation between surfaces 134, 136 of groove 132. A latch projection 148 is adapted to cooperate with a latch recess 138.

In assembly, the base 10, blade elements 80, 82, spacer 84 and cap member 110 are disposed in aligned relation with pins 118 extending through the corresponding apertures 92, 102 and 18. The components are loosely held in stacked relation under light pressure and force is applied through openings 130 to urge the platform surface 52, edge 86 forward against aligning surface 126, and edge 88 forward against aligning surface 128. The assembly is then clamped firmly together and the free ends of pins 118 are expanded in a cold heading operation to secure the components of the blade unit firmly together. Web 72 is then broken and slider 140 is inserted through slot 132 so that curved surface 150 is received in groove 38.

Figure 6:
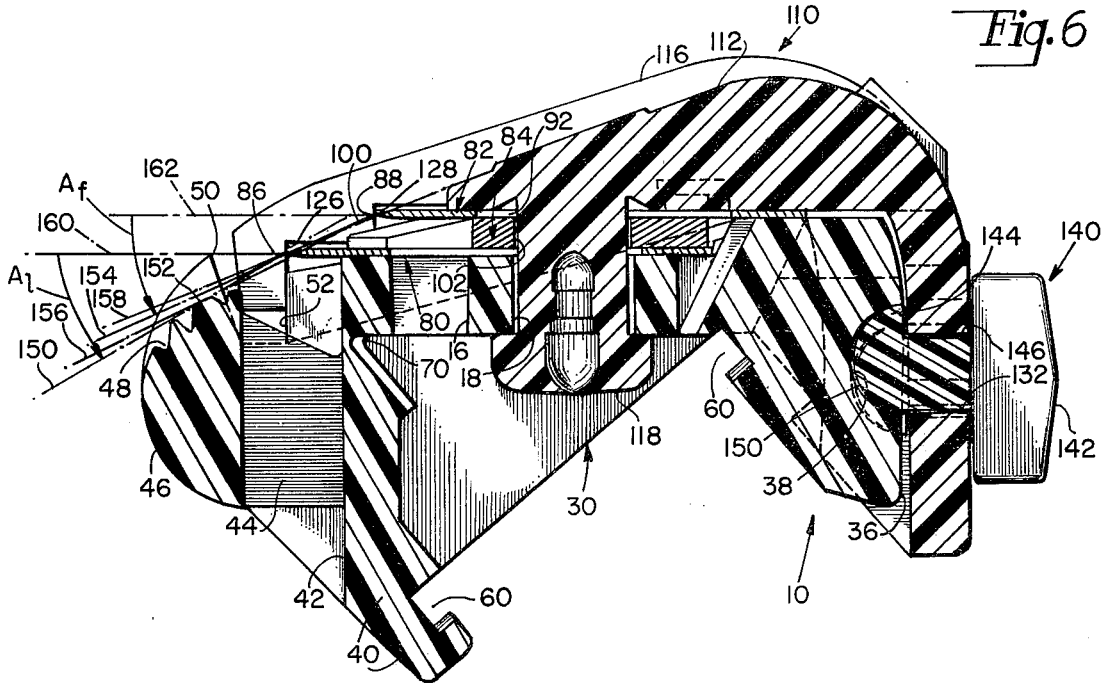
FIG. 6 is a sectional view along the line 6—6 of FIG. 5.

In the assembled blade unit, as indicated in FIG. 6, the cutting edge 86 of leading blade 80 extends beyond the forward wall surface 42 over the recess between that wall and guard member 46, while the cutting edge 88 of the trailing blade 82 is located above the fingers 100 of spacer 84, the spaces between those fingers and the aligned apertures 90, 82 and 16 providing passages which facilitate the flow of lather and debris produced during the shaving operation away from the shaving zone. Hinge 70 is located about 0.04 inch to the rear of edge 86 and about 0.06 inch below that edge.

Figure 5:
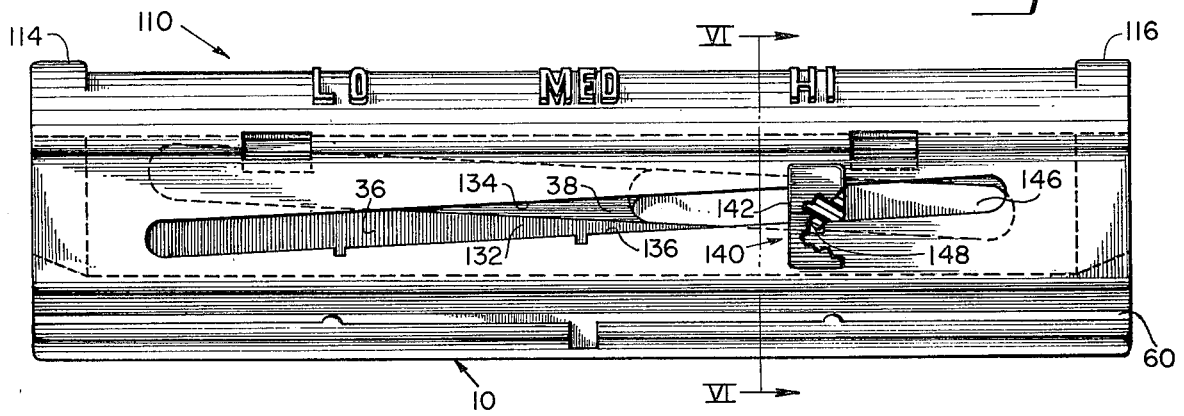
FIG. 5 is a rear view of the assembled blade unit showing the adjusting element 140 in a first position.
Figure 7:
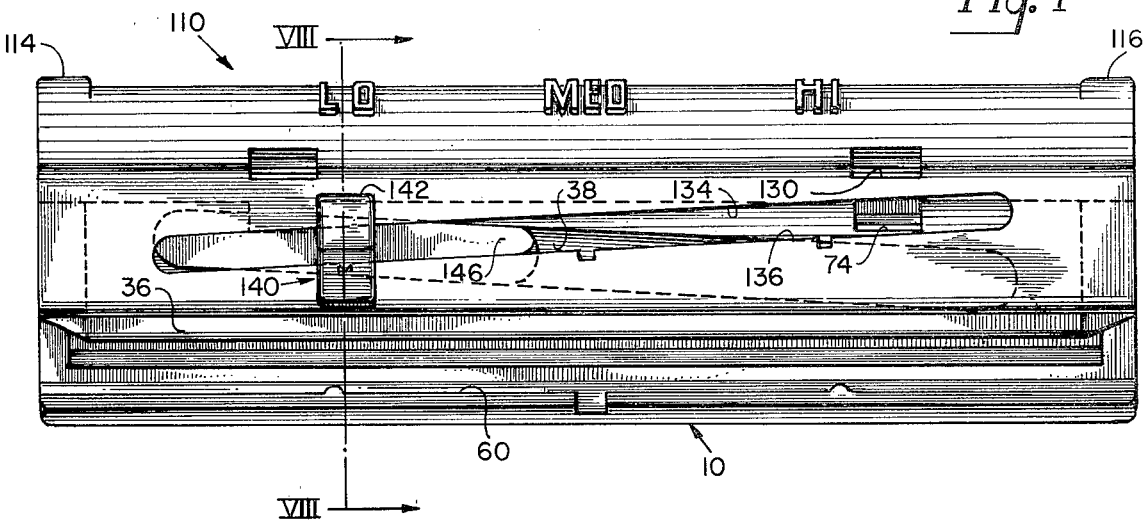
FIG. 7 is a rear view similar to FIG. 5 showing the position of the components of the blade unit with the adjusting element in a second position.
Figure 8:
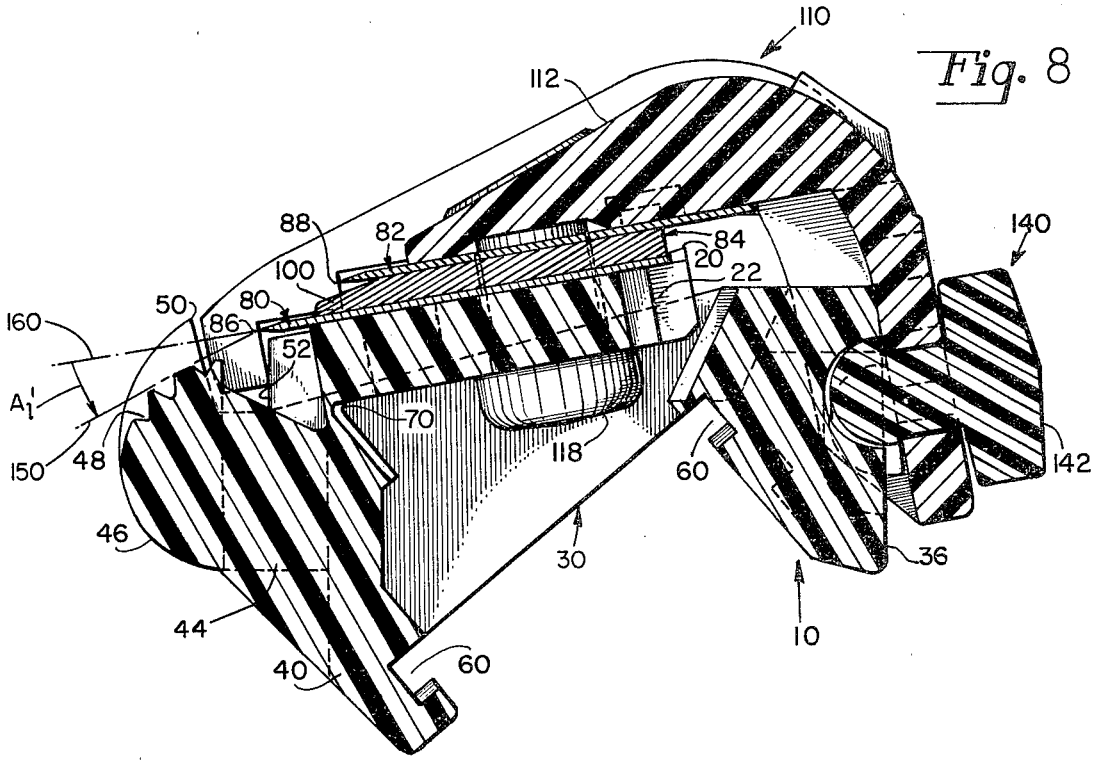
FIG. 8 is a sectional view taken along the line 8—8 of FIG. 7.

In the position of the blade unit shown in FIGS. 5 and 6, the blade unit shaving system has a high blade tangent angle setting and in the position shown in FIGS. 7 and 8, the blade tangent angle setting is low. Relationships useful in defining shaving geometry include "blade tangent angle"—the angular relationship between the bisector of the cutting edge of the blade and the skin engaging surface next forward of that cutting edge; "exposure"—the perpendicular distance of the cutting edge from a plane defined by the skin engaging surface immediately forward of that cutting edge and the skin engaging surface immediately to the rear of that cutting edge; and "span"—the distance between the cutting edge and the next forward skin engaging surface. With reference to the shaving geometry illustrated in FIG. 6, a first reference plane 150 extends from the cutting edge 86 of leading blade 80 to a skin engaging (tangent) point 152 on guard 46; a similar reference plane 154 extends from the cutting edge 88 of following blade 82 to the cutting edge 86 of leading blade 80; a third reference plane 156 is defined by the cutting edge 88 of blade following blade 82 and a line on guard 46; and a fourth reference plane 158 is defined by cutting edge 86 of leading blade 80 and the "tangent" (skin engaging) line on the surface 112 of cap 110. The blade tangent angle of leading blade 80 is the angle $A_l$ between line 160 (the bisector of the facets that define cutting edge 86) and plane 150; the blade tangent angle of the following blade 82 is the angle $A_f$ between the bisector 162 of the facets that define cutting edge 88 and plane 154; leading edge exposure is the perpendicular distance of edge 86 from plane 156; following edge exposure is the perpendicular distance of edge 88 from plane 158; leading edge span is the distance between edge 86 and line 152 on guard 46; and following edge span is the distance between edges 86 and 88.

With the slider 140 in the righthand end position shown in FIGS. 5 and 6, the leading edge tangent angle is about 32°; the following edge tangent angle is about 23°; the leading edge exposure is about +0.005 inch; the following edge exposure is about +0.001 inch; the leading edge span is about 0.07 inch; and the following edge span is about 0.06 inch.

The translation of slider 140 from the right end of the groove 132 to the left end (the position shown in FIGS. 7 and 8) cams the assembly of platform 12, the two blades 80 and 82, spacer 84 and cap 110 about a pivot axis defined by hinge 70. In this position, the leading edge tangent angle is about 20°; the following edge tangent angle is about 23°; the leading edge exposure is about −0.001 inch; the following edge exposure is about +0.001 inch; the leading edge span is about 0.05 inch; and the following edge span is about 0.06 inch.

With the slider 140 in the center position, the leading edge tangent angle is about 26°; the following edge tangent angle is about 23°; both the leading and following edge exposures are about +0.001 inch; and both the leading and following edge spans are about 0.06 inch.

Thus, movement of adjusting member 140 varies leading edge tangent angle, exposure and span in coordinated manner over a significant range of shaving geometries. The system permits either lower or higher shaving geometries to be obtained which are preferred by the shaver in an arrangement that may be reliably mass produced; that does not interfere with or interact with the handle coupling; and that provides a range of accurate, stable and reproducible shaving geometries.

Figure 9:
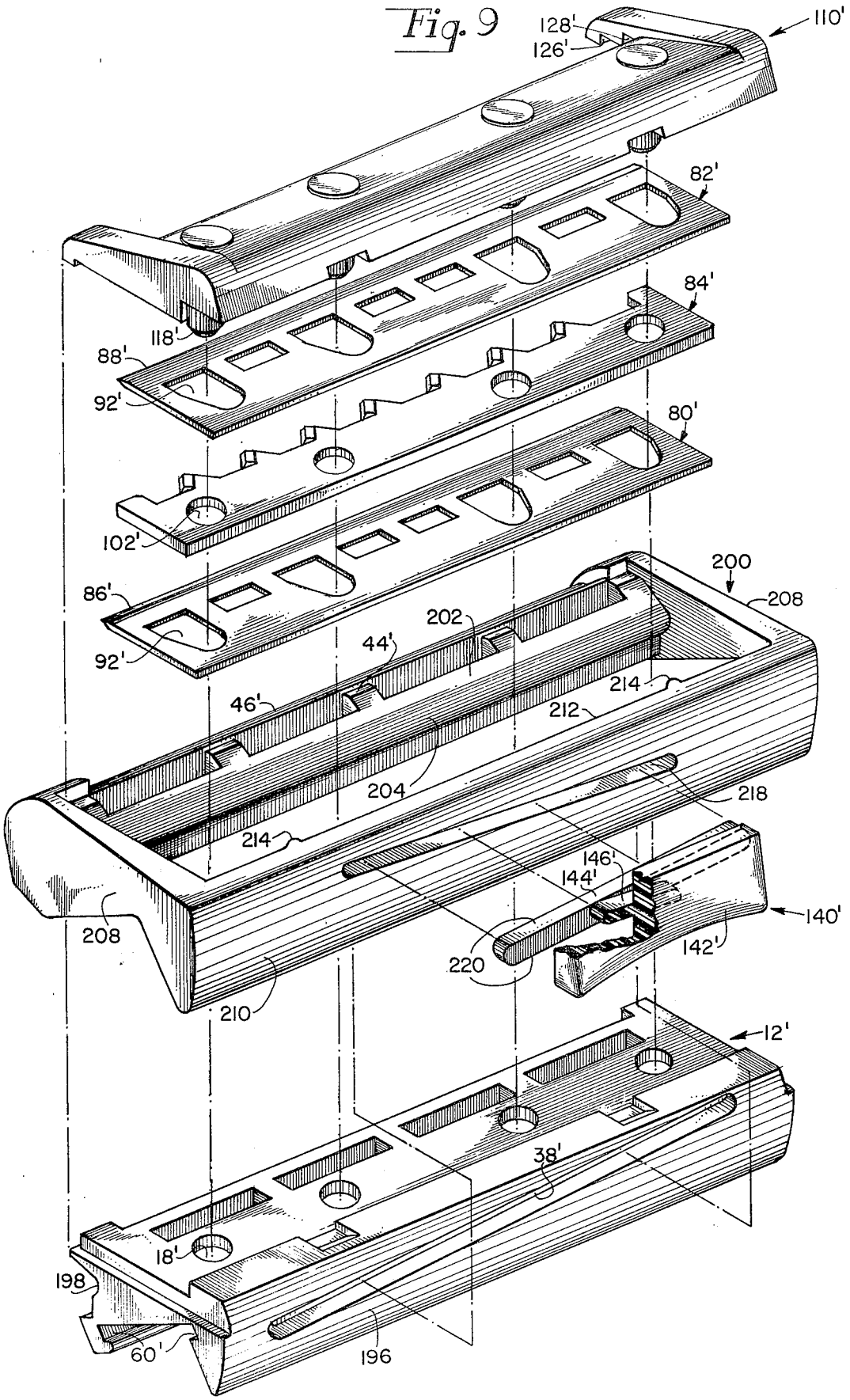
FIG. 9 is an exploded perspective view of a second embodiment constructed in accordance with the invention.
Figure 10:
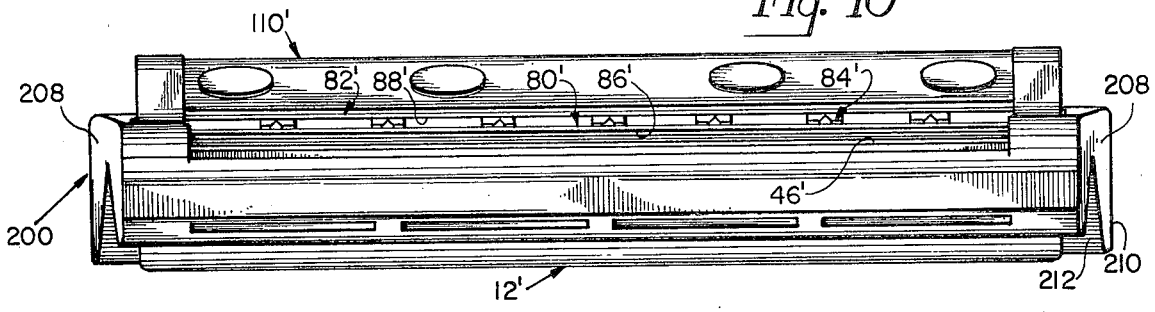
FIG. 10 is a front view of the blade unit of FIG. 9.
Figure 11:
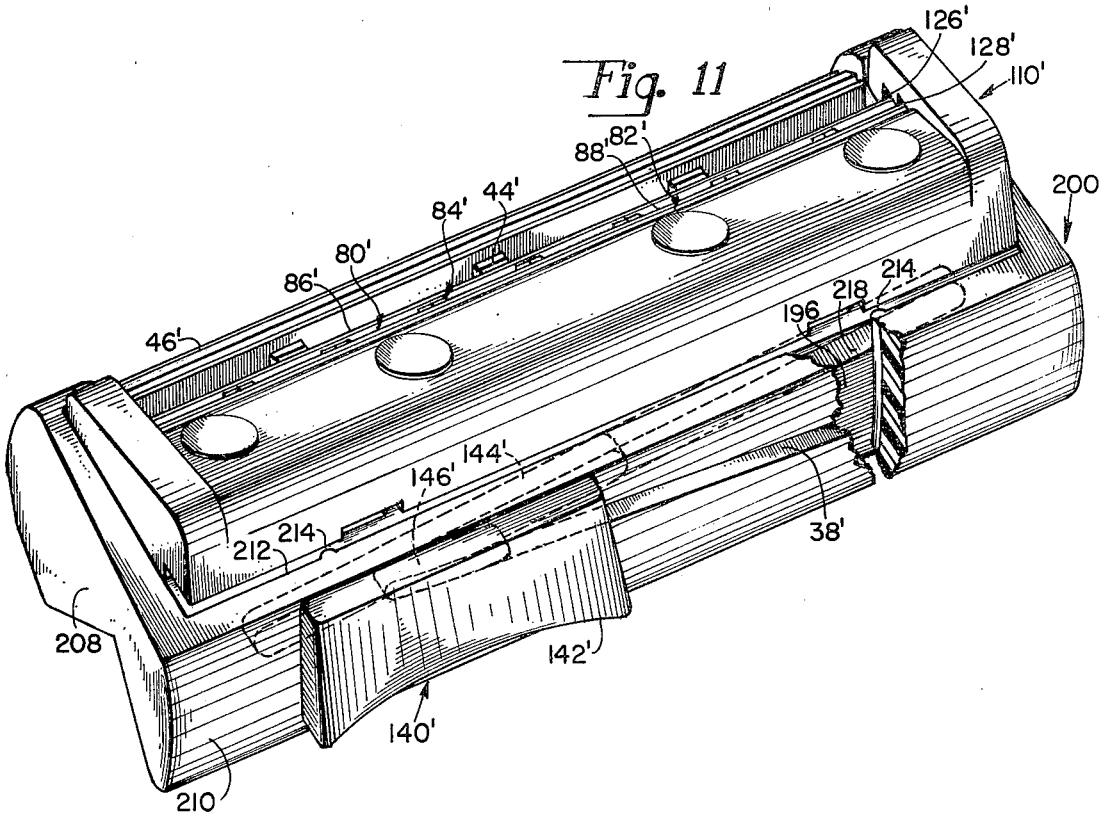
FIG. 11 is a perspective view of the blade unit of FIG. 9.
Figure 12:
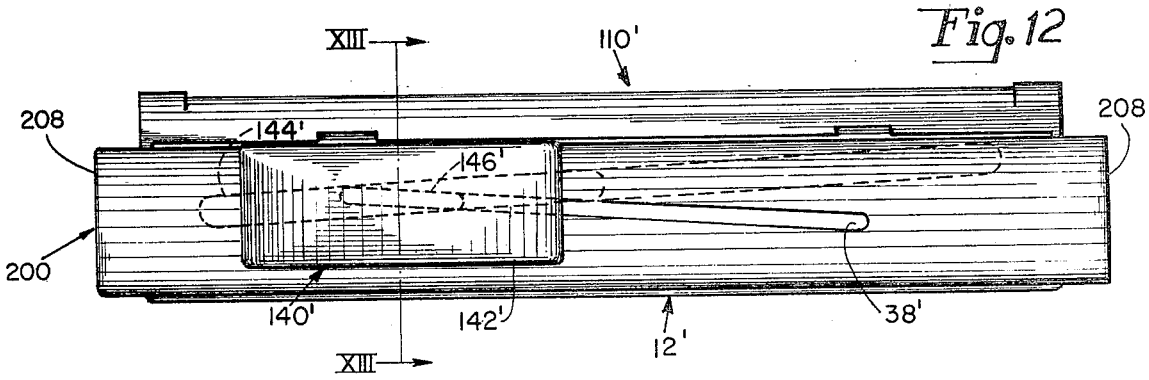
FIG. 12 is a rear view of the blade unit of FIG. 9.
Figure 13:
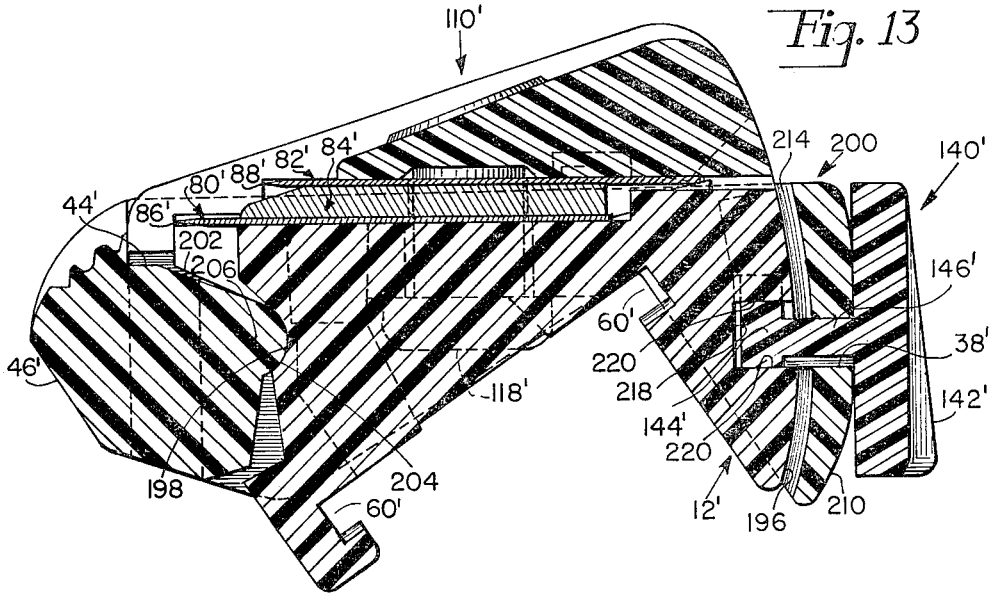
FIG. 13 is a sectional view taken along the line 13—13 of FIG. 12.
Figure 14:
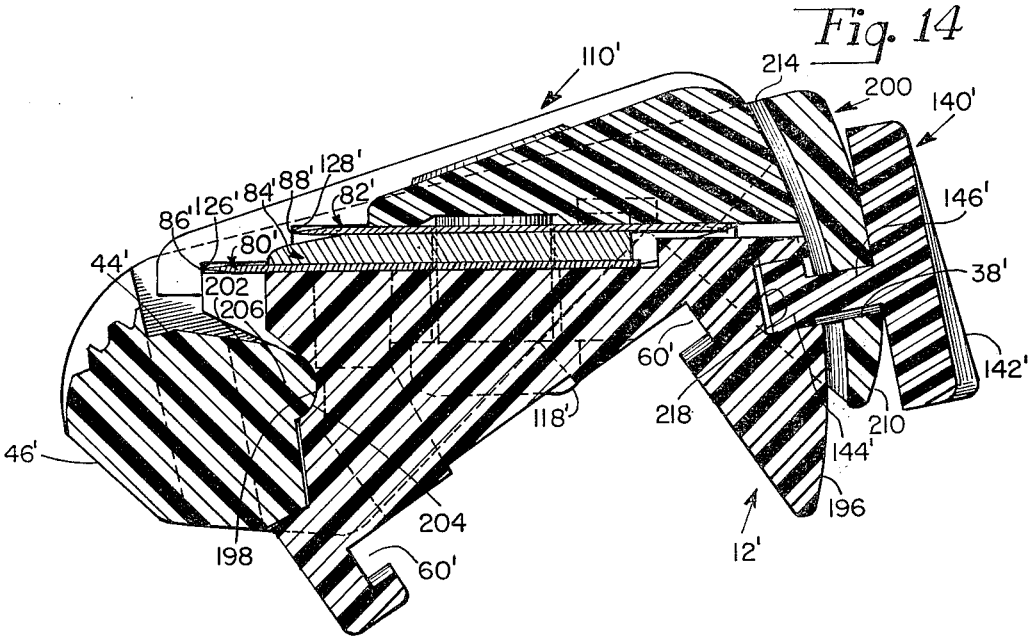
FIG. 14 is a sectional view, similar to FIG. 13, showing the adjusting element in a second position.

An exploded view of another embodiment is shown in FIG. 9; top, perspective and rear views of that embodiment are shown in FIGS. 10–12; and sectional views are shown in FIGS. 13 and 14. That embodiment includes similar leading and following blades 80', 82' with interposed spacer 84'. These elements are clamped in position on platform 12' by cap 110' which has depending posts 118' that extend through apertures 92', 102' and 18' as in the embodiment shown in FIGS. 1–8. Platform member 12' includes adjusting groove 38 in cylindrically curved rear wall bearing surface 196; coupling grooves 60' which are adapted to receive the rails of a cooperating handle component to secure the blade unit to that handle; and socket groove 198 in its front wall.

Guard 46' is formed on a separate frame member 200. That frame member includes the transversely extending guard member 46' that has rearwardly extending webs 44' that connect guard 46' to intermediate member 202. Formed in the rear surface of member 202 is a curved pivot defining surface 204 of cylindrical configuration that has axis 206 (FIG. 13). Side wall portions 208 extend rearwardly from members 46' and 202 to a rear wall member 210. The front wall surface of rear wall 210 is a cylindrical sector curved about the same center 206 as pivot surface 204 and has two projecting ribs 214 that extend the arcuate length of surface 212. Formed in rear wall 210 between ribs 214 is inclined slot 218.

Adapted to be received in groove 218 is slidable adjustment member 140' that includes a handle portion 142', an elongated camming portion 144' and a connector portion 146'. Portion 144' has upper and lower parallel surfaces 220 that are adapted to be received in groove 38' of the platform member and are inclined at an angle of about 3° to the transverse axis of the adjusting member 140'. The connector portion 146' is inclined in the opposite direction from camming portion 144' at an angle of about 3° to the transverse action of adjusting member 140' and is adapted to be received in guided relation between the upper and lower surfaces of slot 218.

In assembly, frame 200 and platform 12' are preassembled with cylindrical surface 204 in socket 198 and ribs 214 in engagement with rear bearing surface 196. The platform 12', blade elements 80', 82', spacer 84' and cap member 110' are then disposed in aligned relation with pins 118' extending through the corresponding apertures 92', 102' and 18'. Force is applied to urge the platform and the blade edges 86' and 88' against aligning surfaces 126' and 128' and the lower ends of posts 118' are expanded to secure the components of the blade unit firmly together. Adjusting member 140' is then inserted through slot 218 so that cam surfaces 220 of portion 144' are received in groove 38' and the neck portion 146' is disposed in slot 218.

Aspects of the overall appearance of the assembled blade unit may be seen with reference to FIGS. 10–12, and sectional views of that blade unit as shown in FIGS. 13 and 14, the sectional view in FIG. 13 showing a low blade tangent angle shaving geometry and FIG. 14 showing a higher blade tangent angle shaving geometry. Movement of slider 140' from the left end of groove 218 is viewed in FIGS. 11 and 12 increases the leading edge tangent angle. This movement of slider 140' causes rotational movement of the blade subassembly relative to the frame member 200, this movement being about pivot axis 206. The interaction of inclined plane members 144' and 146' of the slider 140' produces the adjustment of the shaving geometry. The specific shaving geometry parameter adjustments are a function of the location of pivot axis 206 relative to leading blade edge 86'. Movement paths other than rotation may be employed, for example, rectilinear movement or movement along a curved path. Similarly, the adjusting member may have other configurations for achieving the desired relative movement between components of the blade unit. It is obvious that the invention is also applicable to single or multiple blade unit configurations.

While particular embodiments of the invention and modifications thereof have been shown and described, still other modifications will be apparent to those skilled in the art and therefore it is not intended that the invention be limited to the disclosed embodiment or to details thereof and departures may be made therefrom within the spirit and scope of the invention as defined in the claims.

What is claimed is:

1. A razor blade unit comprising cap structure, a blade member permanently and unremovably secured in fixed relation to said cap structure, said blade member having one side only abutting said cap structure and having an exposed cutting edge, a transversely extending guard member permanently associated with said blade member and defining a guard surface located forward of said exposed cutting edge, structure mounting said blade member for angular movement relative to said guard member, said mounting structure defining a pivot axis that extends parallel to said cutting edge and that is located generally below said exposed cutting edge and forward of said cap structure, said mounting structure permitting the angular orientation of said blade member relative to said guard member to be changed, base structure including coupling structure below said blade member for detachably connecting said blade unit to a cooperating handle component, and adjusting mechanism integral with said blade unit and including an adjusting member located rearwardly of said blade member on the opposite side from said guard member, said adjusting member having a handle portion, a first portion in engagement with a surface of said cap structure and a second portion in engagement with a surface of said base structure, said base structure surface having an offset relative to said cap structure surface that changes along the length of said surfaces, said adjusting mechanism being operable independently of any cooperating handle component for changing the angular orientation of said blade member relative to said guard member to vary the shaving geometry of said blade unit.

2. The blade unit as claimed in claim 1 wherein said pivot axis defining structure is a hinge web.

3. The blade unit as claimed in claim 1 wherein said pivot axis defining structure is a cylinder and socket arrangement.

4. A raxor blade unit comprising blade support structure, a blade member permanently secured in fixed relation on said blade support structure, said blade member having an exposed cutting edge at the forward edge of said blade support structure, a transversely extending guard member permanently associated with said blade member and defining a guard surface located forward of said exposed cutting edge, a flexible connection interconnecting said blade support structure and said guard member, said flexible connection being located adjacent the forward edge of said blade support structure and permitting the angular orientation of said blade support structure relative to said guard member to be changed, and adjusting mechanism integral with said blade unit and operable to change the relative positioning of said guard member and said exposed cutting edge, said adjusting mechanism including a movable element located rearwardly of said blade member on the opposite side from said guard member, said movable element having a handle portion, a first portion engageable with a first surface connected to said blade support structure and a second portion engageable with a second surface connected to said guard member, said first surface having an offset relative to said second surface, the offset of said first surface from said second surface changing along the length of said first surface, said adjusting mechanism being operable independently of any cooperating handle component for changing the relative positioning of said blade and guard members to vary the shaving geometry of said blade unit.

5. The blade unit as claimed in claim 4 wherein said offset changes at a uniform rate along the length of said surfaces.

6. A razor blade unit comprising cap structure, a blade member permanently secured in fixed relation to said cap structure, said blade member having an exposed cutting edge, a transversely extending guard member permanently associated with said blade member and defining a guard surface located forward of said exposed cutting edge, frame structure permanently secured in fixed relation to said guard member and including coupling structure below said blade member for detachably connecting said blade unit to a cooperating handle component, structure mounting said blade member for angular movement relative to said guard member, said mounting structure defining a pivot axis that extends parallel to said cutting edge and that is located generally below said exposed cutting edge, said mounting structure permitting the angular orientation of said blade member relative to said guard member to be changed, and adjusting mechanism integral with said blade unit and operable to change the relative positioning of said cap and frame structures, said adjusting mechanism including first structure defining an elongated groove, second structure defining an elongated slot, said slot and groove being disposed at an angle to one another, and a slider member that has a head portion, a handle portion, and a stem portion connecting said head and handle portions, said handle portion being located rearwardly of said blade member on the opposite side from said guard member, said head portion being received in said groove and said stem portion being disposed in said slot for transverse movement along said slot and groove to change the position of said cap and frame structures relative to one another, said adjusting mechanism being operable independently of any cooperating handle component for changing the angular orientation of said blade member relative to said guard member to vary the shaving geometry of said blade unit.

7. A razor blade unit comprising:

blade means having an exposed cutting edge, a first member permanently secured in fixed relation to said blade means, a second member permanently associated with said blade means and defining a guard surface located forward of said exposed cutting edge, a flexible connection integral with and interconnecting said first and second members, said flexible connection defining a transversely extending axis parallel to and generally below said exposed cutting edge and permitting rotational movement of said blade means about said axis to change the angular orientation of said blade means relative to said guard surface, coupling structure for detachably connecting said blade unit to a cooperating handle component, and adjusting mechanism integral with said blade unit and located to the rear of said blade means on the opposite side of said blade unit from said guard member, said adjusting mechanism including structure in one member defining an elongated groove, an elongated slot in the other member, said slot and groove being disposed at an angle to one another, and a manipulating member that has a head portion, a handle portion, and a stem portion connecting said head and handle portions, said head portion being received in said groove and said stem portion being disposed in said slot for transverse movement along said slot and groove to change the position of said blade means and said guard member relative to one another, said adjusting mechanism being operable independently of any cooperating handle component for changing the relative positioning of said blade member and said guard surface to vary the shaving geometry of said blade unit.

8. The blade unit as claimed in claim 7 wherein two blades and an interposed spacer member are disposed between said first and second members.

9. A razor blade unit comprising cap structure, a blade member permanently secured in fixed relation to said cap structure, said blade member having an exposed cutting edge, a transversely extending guard member permanently associated with said blade member and defining a guard surface located forward of said exposed cutting edge, said guard and blade members being mounted for relative movement along a predetermined path, base structure of molded plastic material including coupling structure below said blade member for detachably connecting said blade unit to a cooperating handle component, said blade member being permanently secured between said cap and base structures, said adjusting mechanism integral with said blade unit and including an adjusting member located rearwardly of said blade member on the opposite side from said guard member, said adjusting member having a handle portion, a first portion in engagement with a surface of said cap structure and a second portion in engagement with a surface of said base structure, said base structure surface having an offset relative to said cap structure that changes along the length of said surfaces, said adjusting mechanism being operable independently of any cooperating handle component for changing the relative positioning of said blade and guard members to vary the shaving geometry of said blade unit.

10. The blade unit as claimed in claim 9 and further including structure connecting said base structure and said guard member and integral therewith, said connecting structure defining a pivot axis extending parallel to and generally below said cutting edge and forward of said cap structure and permitting rotational movement of said blade member about said axis to change the angular orientation of said blade member relative to said guard surface.

11. The blade unit as claimed in claim 10 wherein said pivot axis defining structure is a hinge web.

12. In a razor blade unit comprising coupling structure for detachably connecting said blade unit to a cooperating handle component, a cap member, a blade member having a cutting edge, a platform member, a transversely extending guard member defining a guard surface located forward of said cutting edge, said cap member and guard member having respective surfaces on opposite sides of said cutting edge adapted to engage skin in shaving, said cap and platform members being permanently associated with the blade member and holding said blade member therebetween with the blade member cutting edge exposed between said skin engaging surfaces, and an adjusting mechanism for changing the position of said blade member relative to said guard member to vary the shaving geometry of said blade unit, the improvement of structure connecting said platform member to said guard member that defines a transversely extending axis parallel to and generally below said exposed cutting edge and forward of said cap member and that permits rotational movement of said cap and platform members about said axis to change the angular orientation of said blade member relative to said guard member.

13. The blade unit as claimed in claim 12 wherein said adjusting mechanism includes a manipulating member that is guided for movement along a transverse path, and engages a surface on said blade unit, at least a portion of said blade unit surface being offset relative to said transverse path and said offset changing alone the length of said transverse path so that movement of said manipulating member along said transverse path changes the shaving geometry of said blade unit.

14. The blade unit as claimed in claim 12 wherein said adjusting mechanism includes structure defining an elongated slot, a manipulating member that has a head portion, a handle portion, and a stem portion connecting said head and handle portions, said stem being disposed in said slot for transverse movement along said slot, and structure separate from said slot defining structure defining an elongated groove, said head being received in said groove, and said slot and groove being angularly offset so that transverse movement of said manipulating member changes the position of said blade member relative to said guard member.

15. The blade unit as claimed in claim 12 wherein said connecting structure is in integral hinge web.

16. The blade unit as claimed in claim 12 wherein said connecting structure is a cylinder and socket arrangement.

17. A razor comprising:

base structure having a guard surface and a blade support structure integral therewith, two blade elements permanently secured to said blade support structure with their two cutting edges spaced so that two distinct cutting actions occur on the same beard hair that are successive in time during a single shaving stroke, the front of said blade support structure being secured to said base structure by a flexible connection and the rear of said blade support structure being spaced from and movable relative to said base structure, said flexible connection permitting the angular orientation of said blade support structure relative to said base structure to be changed, and an adjusting mechanism coupled between said base structure and said blade support structure for moving said blade support structure relative to said guard surface to change the angular orientation of said blade support structure relative to said base structure to vary the shaving geometry of said razor.

18. A razor comprising:

base structure having a guard surface and a blade support structure integral therewith, the front of said blade support structure being secured to said base structure by a flexible connection and the rear of said blade support structure being spaced from and movable relative to said base structure, said flexible connection permitting the angular orientation of said blade support structure relative to said base structure to be changed, and an adjusting mechanism coupled with said razor and located to the rear of said blade support structure on the opposite side of said razor from said guard surface, said adjusting mechanism being coupled between said base structure and said blade support structure for moving said blade support structure relative to said guard surface to change the angular orientation of said blade support relative to said base structure to vary the shaving geometry of said razor.

19. The razor as claimed in claim 18 wherein said adjusting mechanism includes a manipulating member that is movable transversely to vary the shaving geometry of the razor.

20. The razor as claimed in claim 18 wherein said base structure includes a wall portion extending downwardly from the front edge of said blade support structure and a plastic hinge is defined by a zone of reduced cross-sectional dimension in said wall portion, said hinge providing said flexible connection between said base structure and said blade support structure.

21. A razor comprising:

base structure having a guard surface and a blade support structure integral therewith, two blade elements permanently secured to said blade support structure with their two cutting edges being spaced apart, the front of said blade support structure being secured to said base structure by a flexible connection and the rear of said blade support structure being spaced from and movable relative to said base structure, said flexible connection permitting the angular orientation of said blade support structure relative to said base structure to be changed, and an adjusting mechanism coupled between said base structure and said blade support structure for moving said blade support structure relative to said guard surface to change the angular orientation of said blade support structure relative to said base structure to vary the shaving geometry of said razor.

* * * * *